United States Patent [19]

Weber

[11] Patent Number: 4,867,071

[45] Date of Patent: Sep. 19, 1989

[54] TRUCK-MOUNTED ARTICULATED CONNECTOR FOR RAILWAY CARS

[75] Inventor: Hans B. Weber, Rotaonda West, Fla.

[73] Assignee: National Castings, Inc., Oakbrook Terrace, Ill.

[21] Appl. No.: 180,996

[22] Filed: Apr. 13, 1988

[51] Int. Cl.[4] ..... B61D 15/00

[52] U.S. Cl. ..... 105/4.1; 213/7

[58] Field of Search ..... 105/3, 4.1, 4.2, 4.3; 213/7, 40 R, 405, 188, 192, 208; 280/483, 484

[56] References Cited

U.S. PATENT DOCUMENTS

| | | | |
|---|---|---|---|
| 2,843,056 | 7/1958 | Browne | 105/4.3 |
| 2,922,531 | 1/1960 | Hammond | 105/3 X |
| 3,399,631 | 9/1968 | Weber | 105/4 |
| 3,521,569 | 7/1970 | Muotka et al. | 105/3 X |
| 3,646,604 | 2/1972 | Tack et al. | 105/4 R |
| 3,650,219 | 3/1972 | Seely | 105/4.1 |
| 3,721,482 | 3/1973 | Tack et al. | 308/72 |
| 3,906,868 | 9/1975 | Kalencyk et al. | 105/4 R |
| 3,961,582 | 6/1976 | Paton et al. | 105/3 |
| 3,985,236 | 10/1976 | Martin | 213/75 R |
| 4,191,107 | 3/1980 | Ferris et al. | 105/4 R |
| 4,202,454 | 5/1980 | Browne et al. | 105/3 X |
| 4,233,909 | 11/1980 | Adams et al. | 105/4 R |
| 4,258,628 | 3/1981 | Altherr | 105/4 R |
| 4,315,465 | 2/1982 | Cordani et al. | 105/4 R |
| 4,336,758 | 6/1982 | Radwill | 105/4 R |
| 4,452,163 | 6/1984 | Ayeva | 114/77 R |
| 4,485,743 | 12/1984 | Roush et al. | 105/176 |
| 4,531,648 | 7/1985 | Paton | 213/50 |
| 4,593,829 | 6/1986 | Altherr | 213/75 R |
| 4,644,871 | 2/1987 | Arrey et al. | 105/4.1 |

FOREIGN PATENT DOCUMENTS

| | | | |
|---|---|---|---|
| 1039772 | 9/1983 | U.S.S.R. | 105/3 |

*Primary Examiner*—Johnny D. Cherry
*Assistant Examiner*—Frank H. Williams, Jr.
*Attorney, Agent, or Firm*—Milton S. Gerstein

[57] ABSTRACT

An improved articulated connector or coupler in which the connection between the male connecting member and female connecting member via a king pin is provided with an elastomeric bushing housed in the male connecting member. The bushing has an outer metallic ring, and inner metallic ring, and a middle ring of elastomeric material, by which a coupling free of uncontrolled slack is achieved and by which all normal draft and buffing, as well as train-action and angling, forces, are damped and partially absorbed by the elastomeric ring. For excessive loads, in order to protect the elastomeric ring, over solid metal-to-metal stops are provided which shunt the force transmittal from the eleastomeric ring to metal stop-surfaces. The king pin is also frustroconical in shape at the intermediate portion thereof passing through the bushing of the male connecting member, which bushing has a similarly-shaped frustroconical passageway.

20 Claims, 3 Drawing Sheets

TRUCK-MOUNTED ARTICULATED CONNECTOR FOR RAILWAY CARS

BACKGROUND OF THE INVENTION

The present invention is directed to an articulated connector or coupler for railway cars. Prior art articulated couplers are shown in the following U.S. Pat. Nos. 3,399,631—Weber; 3,646,604—Tack, et al; 3,721,482—Tack, et al; 4,258,028—Altherr; 4,336,758—Radwill; 4,531,648—Paton, and 4,593,829—Altherr. The present invention is an improvement over these prior art articulated connectors or couplers.

Articulated couplers are presently used to semipermanently connect two or more railroad car body modules together in order to form a large railroad vehicle, in which there is provided a railroad truck or bogie under each articulated connection for supporting same, and an additional truck or bogie located under each unconnected end of the two end-modules of the large railroad vehicle made up of the plurality of individual car modules. The articulated connector allows for not only relative horizontal pivotal movement between adjoining and coupled ends of two adjacent car modules (angling such as in curves), but also allows for relative vertical/angling and movements therebetween, in order to accommodate track inclines and declines, as well as general differences in vertical heights of the adjoining ends of the adjacent modules due to track conditions or tolerances and wear of parts within the articulated connector itself.

Prior art articulated connectors provide a certain amount of longitudinal free slack between their connector parts due to tolerances and wear of their component parts, which generally causes uncontrolled longitudinal train action with high forces harsh metal-to-metal contact, and accelerated wear, which reduces the operating life cycle of the articulated connector. Such wear caused mainly by free slack is also undesirable in that it permits interference between cooperating elements of the male and female parts constituting the articulated connector, which, under certain conditions, leads to the binding or locking of parts, galling, and the associated damage and breakdown of the connector. Attempts to eliminate this free slack have concentrated on the use of a wedge or shim between the end-spherical surface of the male part of the connector and the opposing end-surface of the cavity of the female part receiving the male part. However, such an approach has still not prevented locking or binding although the wear of parts might be only moderate and certainly not excessive.

SUMMARY OF THE INVENTION

It is the primary objective of the present invention to provide an articulated connector or coupler for a railroad car that is free of uncontrolled slack, and thereby prevents uncontrolled longitudinal train action, high longitudinal forces, harsh metal-to-metal blows, accelerated wear and binding of parts during movements experienced under normal operating conditions.

It is an objective o& the present invention to provide an articulated connector without uncontrolled free slack that achieves operation without the use or need of wedge blocks or shims.

It is an objective of the present invention to provide an articulated connector free of uncontrolled slack that will not bind even after settling and wear of parts and concomitant vertical height differentials thereof.

It is another objective of the present invention to provide an articulated connector having considerably fewer parts as compared with prior art articulated connectors, thus providing greater ease of repair and maintenance, easier and less costly assembly, and longer operating life.

It is another objective of the present invention to provide an articulated connector or coupler for a railroad car that is of reduced weight as compared to prior art articulated connectors or couplers.

The articulated connector of the present invention provides a connection free of uncontrolled slack between the male and female parts thereof via a central bushing member which incorporates therein a middle elastomeric core. The bushing is part of the male connector, is circular in cross section, and has an outer and inner layer of steel sandwiching therebetween the middle layer of elastomeric material. The inner layer of steel is formed with a central opening for receiving a central king pin of the connector or coupler unit, which central opening, in the preferred embodiment, forms a truncated-cone shape for receiving the similarly-shaped portion of the king pin, which conical shape allows for ease of installation and prevention of free slack. The bushing proper is received in a circular cavity formed in the male connecting part. The bushing, with its elastomeric core, provides a highly damped, relatively small amount of movement, so that normal buffing and draft forces will be cushioned, thereby reducing force peaks of such longitudinal forces. The forward-most end surface of the male connecting part is formed in the shape of a convex cylinder (outside diameter), rather than spherical, with a flat or slightly profiled band around the center at the height of the coupling line and upper and lower portions tapering toward the vertical center line of the cylinder, which cooperates with an inside cylindrical surface of the associated cavity of the female connecting part of the unit, so that for all wear conditions and states, no locking or binding of parts can occur due to vertical misalignment of the respective longitudinal axes (coupling lines) of the cylindrical surfaces of the male and female connector parts. In the preferred embodiment, the central portion of the cylindrical surface of the male part is spaced ¼ inch from the cylindrical surface of the female part to allow for ¼ inch highly damped and, therefore, controlled relative movement therebetween, which accommodates forces up to approximately 250,000 pounds, or approximately 90% of all train action forces. In order to protect the elastomeric layer of the bushing against buffing forces exceeding 250,000 pounds, the longitudinal movement facilitated by elastomeric bushing shunts the force transmittal to the solid cylindrical surfaces of the male and female connector parts. Similar protection, but against excessive draft forces, is provided by over-solid stops of the bushing cover plate and king pin and the support shelf o& the bushing and king pin.

BRIEF DESCRIPTION OF THE DRAWING

The invention will be more readily understood with reference to the accompanying drawing, wherein.

DESCRIPTION OF THE INVENTION

Figure 1:
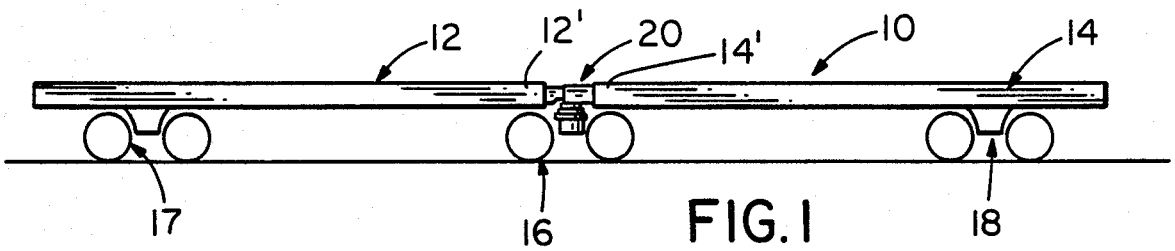
FIG. 1 is a side view showing two railroad car modules joined together via the articulated connector or coupler of the present invention to form a large railroad vehicle.
Figure 2:
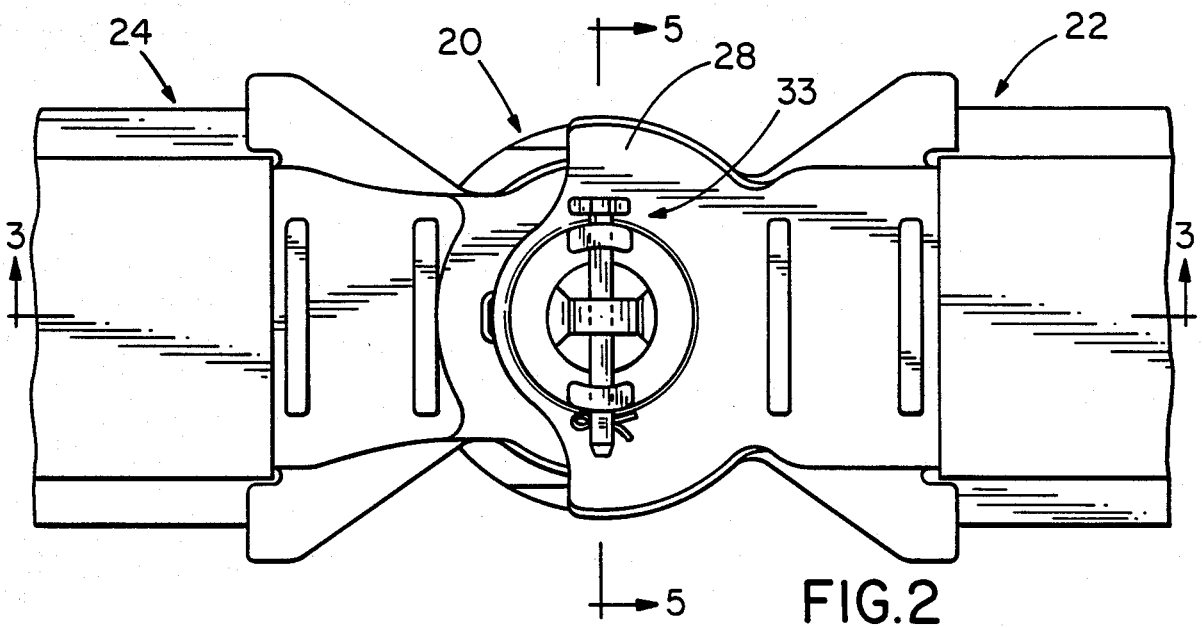
FIG. 2 is a top view of the articulated connector or coupler of the invention.

Referring now to the drawings in greater detail, FIG. 1 depicts the environment in which the articulated coupler of the invention is used. A large railroad car 10 is formed by two smaller car modules 12, 14. The ends 12' and 14' are articulately interconnected together via the connector or coupler 20 of the present invention, which connector 20 is supported on a lower truck or bogie 18 in conventional fashion via the truck center bowl thereof supporting the lower center plate formed in the lower portion of the female part of the connector 20, described below in greater detail. End trucks 17, 18 are used for supporting the free, unconnected ends of the modules 12, 14 in conventional manner. While only two modules 12, 14 have been shown, many more such modules may be articulately coupled together to form a larger railroad car unit, with a connector 20 being used to interconnect adjacent ends of two adjoining car modules.

Referring now to FIGS. 2–6, the connector or coupler 20 of the invention is shown in detail. The connector 20 includes a female connector part 22 which is welded to the center sill of the end 14' of the module 14, and a male connector part 24 which is welded to the center sill at the end 12' of the car module 12. The female connector part 22 defines an interior chamber 2G in which is telescopingly received the protruding portion of the male connector part 24. The chamber 26 is delimited by an upper horizontal wall portion 28 having a vertical bore therethrough for passing a king pin 30, and a lower horizontal wall portion 32. The lower horizontal wall portion 32 projects downwardly in order to form a lower center plate 32', which is received in a truck center bowl 34 of the truck or bogie 18, whereby the connector unit 20 is supported thereby and for allowing a limited amount of horizontal rotational movement in the conventional manner. A wear liner 33 may also be provided. The lower horizontal wall portion 32 also defines an upwardly projecting central sleeve member or hub 36 having a central aperture for the passage of the lower portion of the king pin 30, described below in greater detail. The upper and lower king pin opening of the female connector part may be equipped with hardened wear liners.

Figure 3:
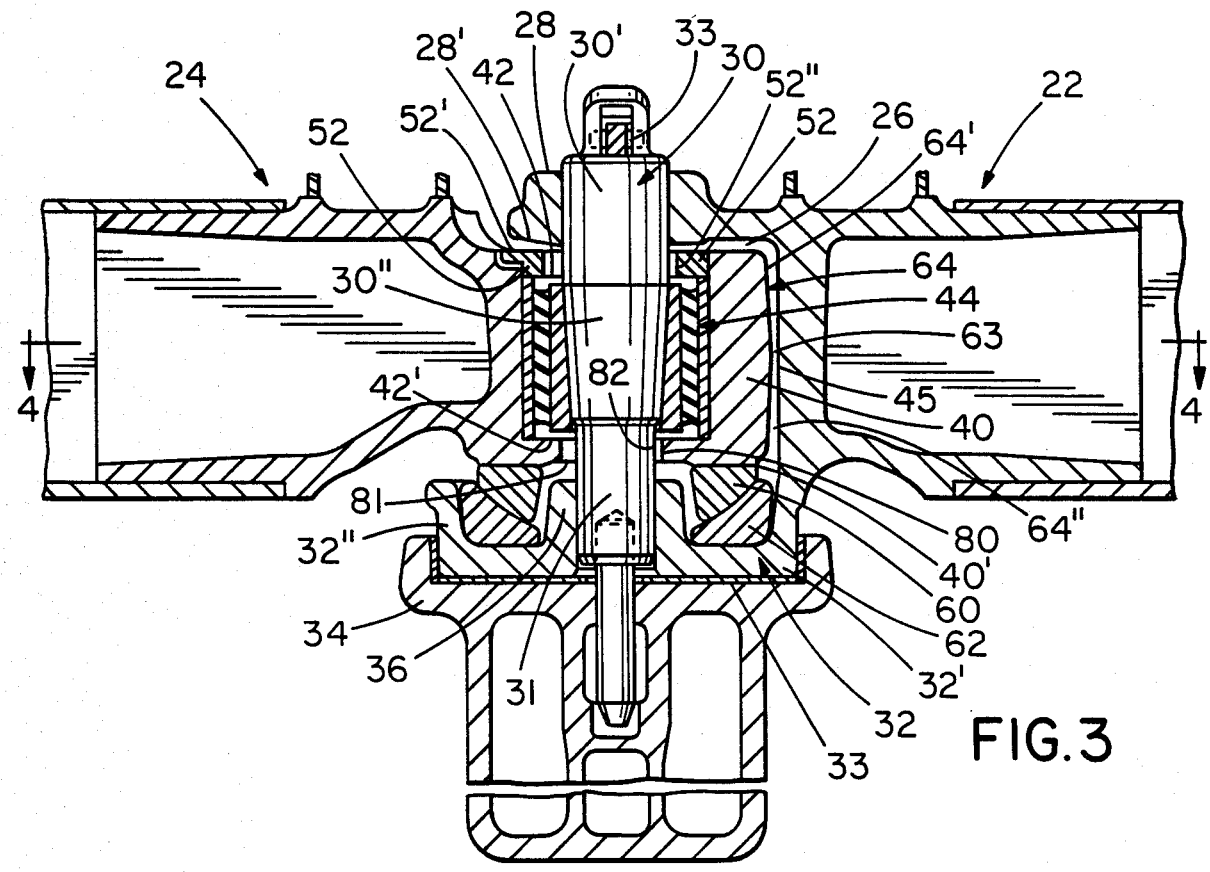
FIG. 3 is a longitudinal cross-sectional view taken along line 3—3 of FIG. 2.
Figure 6:
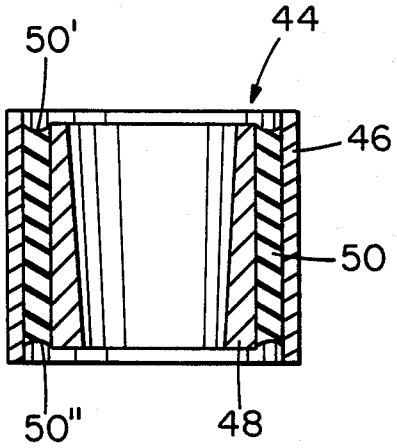
FIG. 6 is transverse cross-sectional view of the elastomeric bushing of the articulated connector or coupler of the invention.

The male connector part or member 24 includes the forward telescoping portion 40 which is telescopingly received within the cavity or chamber 26. The male member is provided with a circular chamber or cavity 42 in which is snugly received a bushing 44 of circular cross-section. The bushing 44 is made up of a first outer circular layer or ring of steel 46 (see FIG. 6), a second inner circular layer or ring of steel 48, and a third middle circular layer or ring of elastomeric material 50. This bushing 44, through its elastomeric core or middle layer 50, with its hysteresis-type damping, absorbs energy of buffing, draft and lateral forces to which the coupler or connector 20 is subjected. This layer of elastomeric material is, in the preferred embodiment capable o: withstanding up to approximately 250,000 pounds of draft and buff forces without any larger amount of relative longitudinal movement between the male and female members of the coupler or connector 20, to thus provide an articulated connector or coupler being free of uncontrolled free slack but having a highly damped, i.e. controlled, longitudinal movement of not more than ¼ inch. As can be seen in FIGS. 3 and 6, the inner layer of steel 48 has less height than the outer layer of steel 18 to provide a clearance at the top and bottom which allows angular and radial movement of the inner cylindrical layer or ring during angling of the male and female parts relative to each other. The fact that the outer metal ring 46 is of greater height is also advantageous to the mounting of the bushing 44 in the chamber 42. The elastomeric ring or layer 50 is preferably provided with concave upper and lower edge surfaces 50' and 50'', with the height of this elastomeric ring being preferably even less than that of the inner metal ring 48, so that upon compression, the elastomeric ring has ample space in which to expand. The chamber or cavity 42 is closed off via a bushing cover plate 52 which provides clearance for the vertical or angular movement of the elastomeric ring 50 and the inner metal ring 48 during angling. The bushing 44, in the preferred embodiment, has an outer diameter of 8¼ inches, as defined by the outer surface of the outer metal ring 46, the thickness of the outer ring 46 being 0.50 inches. The elastomeric ring 50 has a thickness, in the preferred embodiment, of 0.75 inches, and an outer diameter of 7.25 inches, and is preferably made of rubber having a durometer hardness of Shore 81 SBR, N.C.I. Spec. No. 75. The inner steel ring 48 has an upper circular opening of 4.75 inch diameter, and a lower circular opening of 3.986 inch diameter. The height of the outer metal ring 46 is preferably 7.00 inches, with the height of the elastomeric ring 50 being 5.75 inches as measured between the bases of the opposing concave outer edge surfaces.

Figure 4:
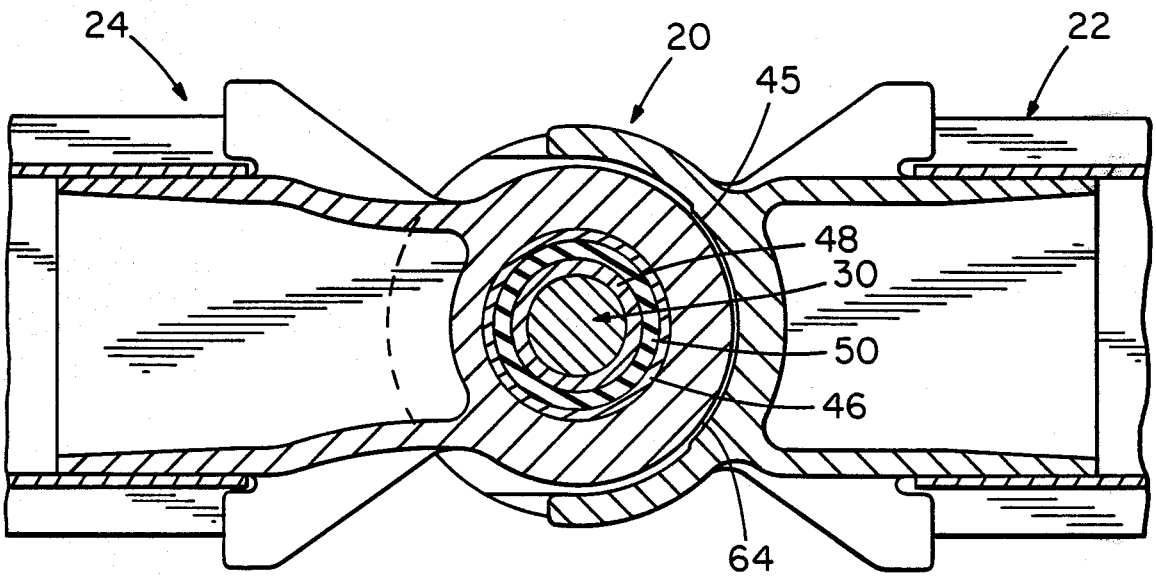
FIG. 4 is a longitudinal cross-sectional view taken along line 4—4 of FIG. 3.
Figure 5:
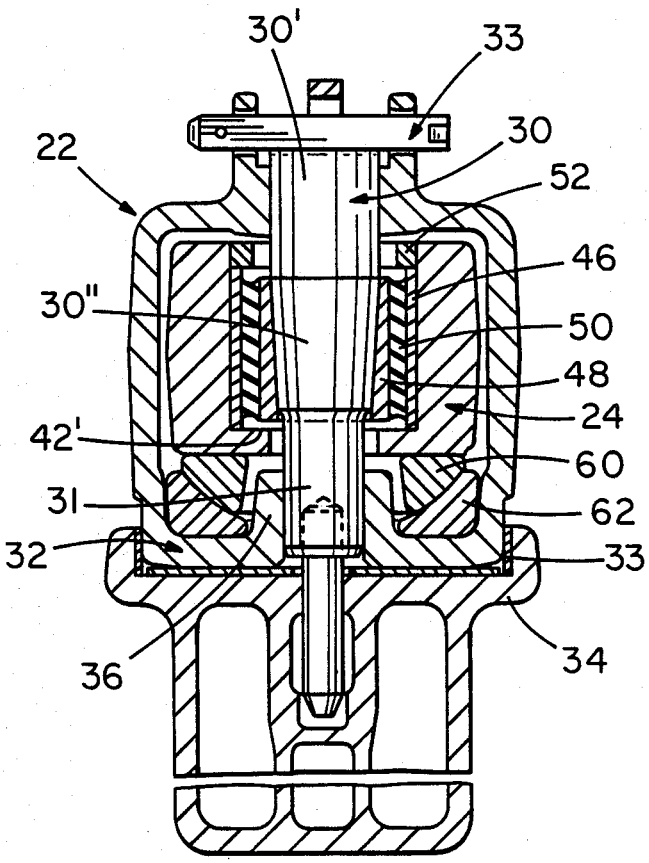
FIG. 5 is a transverse cross-sectional view taken along line 5—5 of FIG. 2.
Figure 7:
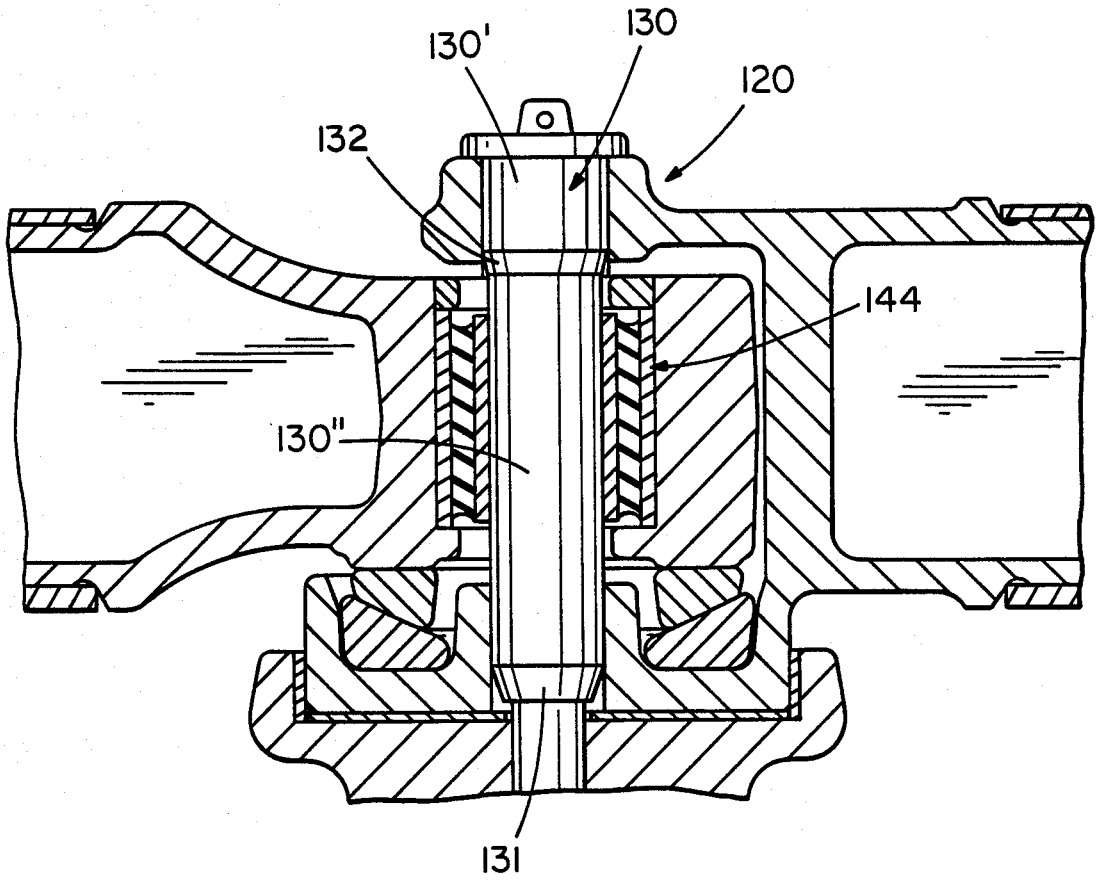
FIG. 7 is longitudinal cross-sectional view of a second embodiment of the invention in which a straight king pin is employed in the connector or coupler of the invention.
Figure 8:
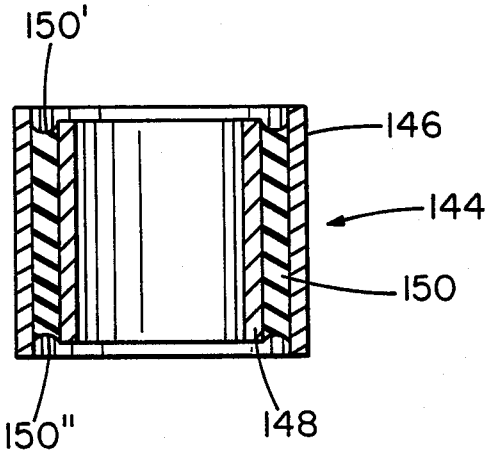
FIG. 8 is a transverse cross-sectional view of the elastomeric bushing of the second embodiment of FIG. 7.

The cover plate 52 is formed with a partial central circular opening for the reception therethrough of the upper portion of the king pin, such partial circular opening being located toward the female connector part and being of greater diameter than the upper portion 30' of the king pin, so as to allow for relative longitudinal movement and clearance, ¼ inch in the preferred embodiment, during angling. The vertical surface of this partial central circular opening is angled slightly upward and away from the king pin so as to permit angling without interference of the cover plate of the male connector part and king pin. The back portion of the central opening, toward the main body and the sides of the male connector part, is elongated and widened as to permit a clearance larger than the ¼ inch provided in the front. The king pin 30, held in place via a retaining key and cotter pin assembly 33, also has a middle frustro-conical section 30'' which fits snugly in a frustro-conical shaped opening formed in the inner steel ring 48 of the bushing 44. This frustro-conical arrangement provides ease of connection of the female and male parts, since, once the lower cylindrical section 31 as well as the upper cylindrical section 30' of the king pin have found the upper and lower openings of the female connector part through which it is to pass, one need only thereafter force the king pin down as by hammering to achieve the substantially automatic alignment of the openings. The angle of taper of the truncated-cone section 30'' of the king pin is between 2 and 7 degrees, with the preferred being 3½ degrees. As can be seen in FIG. 3, the frustro-conical face of the bushing and king pin has a self-adjusting and/or compensating effect against wear of the interfacing surfaces. Since the king pin does not rest on the truck center plate or at any other place and is solely supported only by the conical interface with the bushing, wear at the interface will be taken up by the king pin moving down due to gravity. This configuration also allows for the relative movement of the bushing when necessary during vertical angling. The lower surface 28' is preferably radially tapered 6 degrees from the center of the king pin hole and spaced ⅛ inch from the upper horizontal surface 52' of the cover plate 52 to allow for proper clearance during the relative angling of the female and male members. Similarly, the lower horizontal surface of the inner metal ring 48 is spaced from the lower horizontal surface 42' of the chamber 42 for clearance purposes, which in the preferred embodiment is ⅜ inch. In conventional fashion, the male member's lower surface 40' is supported on a convex spherical ring bearing 60 which cooperates with a lower concave spherical ring bearing 62 seated in the annular region between the hub or sleeve 36 and upstanding rim 32'' of the wall portion 32. These ring bearings, in the conventional manner, allow for the necessary relative shifting and angling of the female and male connector parts during vertical angling and car roll. Of course, it is within the scope and purview of the present invention to provide a conventional straight king pin having a conventional cylindrical intermediate portion rather than the frustro-conical portion above-described, with the opening of the bushing also being cylindrical in shape rather than frustro-conical, as shown in the embodiment of FIGS. 7 and 8, where the king pin 130 has a first upper section 130' of cylindrical shape, and a lower section 130'' also of cylindrical shape, which lower portion 130'' is also formed with a lowermost frustro-conical portion 131 that also aids in the alignment and assembly procedure. Such assembly is also facilitated by the smaller diameter of the lower section 130'' as compared with the upper section 130'. The lower conical section 131 is greater in h eight than the upper conical section 132, so that the lower conical section 131 first comes into play during assembly by first entering into the lower cylindrical opening of the male member after having passed through the opening in the female member. At this point, after the lower conical section has entered sufficiently enough into the lower opening of the male member, the upper conical section 132 enters into the upper cylindrical opening of the female member; when this occurs, applied downward force on the king pin will cause the simultaneous alignment of the parts. The elastomeric bushing 144 has layers 140, 148 and 150, similar to the layers 48, 48, and 50, with the central opening thereof being cylindrical rather than frustro-conical. The forward-most portion of the male connecting part 40 is generally formed into an outside cylindrical surface 64 as shown in FIGS. 3 and 4. This cylindrical surface cooperates with an inside cylindrical surface 45 formed in the end wall of the cavity or chamber 26. These two cylindrical surfaces serve as solid, metal-to-metal stops to the relative longitudinal movement of the male and female parts, which would occur for buff forces above 250,000 pounds, as described above. These stops prevent damage to the elastomeric ring 50 as might occur with excessive buffing loads. Also, preferably, with the exception of a center portion, the outside cylindrical surface 64 is tapered or cut back to define tapering radial surfaces 64' and 64'', which tapering allows for less likelihood of locking of these cooperating surfaces during angling. The center portion is either flat or formed by a radius struck from a point on the coupling line and the center line of the king pin. The use of the cylindrical abutment surfaces 45 and 64, instead of the spherical surfaces of the prior art, ensures that locking will not occur, as when the vertical alignment of the male and female parts no longer exists, due to wear and tear, settling of parts, initial misalignment, by tolerances, and the like. Thus, in prior art spherical surfaces, when the longitudinal center lines of the male and female parts are no longer coextensive, and a true spherical center no longer exists, locking and gouging will be prevalent, whereas in the present invention, for all intents and purposes, no such locking or gouging would occur. In the preferred embodiment, the spacing between the vertical central section 63 and the opposite vertical section of the inside cylindrical abutment stop surface 45 is ¼ inch which is the maximum movement allowed in order to protect the elastomeric ring 50, as described above. The elastomeric bushing 44 is also protected against excessive draft forces by the over-solid, vertical, circular stop surfaces 80, 82, the surface 80 being defined by the inner annular surface of the lower circular opening 81 of the male member 24, and the surface 82 being defined by a outer circumferential surface portion of the cylindrical portion 31 of the king pin and the similar over-solid vertical, circular stop surfaces 52'' of the bushing cover plate 52 and the upper cylindrical portion 30' of the king pin 30. In the preferred embodiment, the spacing between the stop surfaces 80 and 82 and 52'' and 30' is ¼ inches, for the same reasons as described above for excessive buff forces. Of course, forces arising out of vertical angling or car roll of the car bodies and normal train action will also be reduced and damped by the elastomeric ring 50, with the ¼ inch clearance described above providing for protection against excessive forces damaging the elastomeric ring. Thus, it may be seen that for all normal load and angling forces, the elastomeric bushing reduces and dampens all force-transmission, thus obviating solid metal-to-metal contact. For excessive forces, as described above, the over solid-to-solid surfaces take over to prevent damage to the elastomeric bushing.

The articulated connector or coupler 20 of the invention has only a total of 8 parts exclusive of the retaining key and cotter pin. With the elastomeric bushing 44 and bushing cove plate 52 assembled into the male connector unit, the user has to handle only 6 parts. Operating parts that might have to be replaced in service due to wear are, at the most, 5 parts. This compares to 15 parts on the prior-art articulated couplers, of which 13 might need replacement in service. The lower number of parts, higher, wider, and relative simplicity of design also makes the coupler or connector 20 lighter in weight as compared to prior art connectors or couplers.

While a specific embodiment of the invention has been shown and described, it is to be understood that numerous changes and modifications thereof may be made without departing from the scope, spirit and intent of the invention as set forth in the appended claims.

What I claim is:

1. In an articulated connector or coupler for railway cars, which connector or coupler comprises a female connecting member securable to an end of a first railway car, and a male connecting member securable to an end of another railway car, said female connecting member comprising a cavity for receiving therein a projecting portion of said male connecting member, said female connecting member having at least one opening for the passage therethrough of a king pin for rotatably uniting said male and female members together, the improvement comprising:

said male connecting member comprising an elastomeric bushing means, said projecting portion of said male connecting member comprising a hollow chamber in which is positioned said elastomeric bushing means; said bushing means comprising a central through-opening for the passage of a portion of a king pin therethrough;

said bushing means being circular in cross section and comprising a first outer metal ring, a second inner metal ring, and a third middle ring of elastomeric material, said central through-opening being formed in said second inner metal ring; said first outer ring having a height greater than the height of either of said second and third rings.

2. The improvement according to claim 1, wherein said projecting portion of said male connecting member comprises a bushing plate means positioned in the upper portion of said hollow chamber for retaining said bushing means in said hollow chamber, the upper edge surfaces of said second and third rings being spaced from the undersurface of said plate means, whereby clearance is provided for the angular movement of said bushing in said hollow chamber and for allowing ease of installation; said plate means also having an opening for the passage therethrough of a portion of a king pin.

3. The improvement according to claim 1, wherein the height of said second ring is greater than the height of said third ring, said third ring defining an upper and a lower concave edge surface for expansion of said elastomeric ring during compression.

4. The improvement according to claim 1, in combination with a king pin, said king pin comprising an intermediate portion having a frustro-conical shape defining a tapering outer surface; said central through-opening of said second inner ring of said bushing means having a frustro-conical shape for receiving therein said intermediate portion of said king pin, whereby assembly of said male and female connecting parts with said king pin is facilitated, and whereby inherent wear-compensation is provided by the interface between said bushing means and said intermediate portion of said king pin.

5. The improvement according to claim 1, in combination with a king pin; said king pin passing through said at least one opening of said female connecting member and through said central through-opening of said bushing means; said male connecting member further comprising a lower opening positioned below and in alignment with said central through-opening of said bushing means through which passes a portion of said king pin; said king pin comprising at least a lower portion thereof that is substantially cylindrical in shape, said lower opening being greater in expanse than said lower portion of said cylinder and defining an inner annular surface surrounding the circumferential surface of said lower portion of said king pin to define a clearance therebetween at least along a portion thereof, said surfaces defining over-solid surface stops to limit the amount of compression experienced by said elastomeric bushing during excessive draft load forces.

6. The improvement according to claim 1, wherein said cavity of said female connecting member comprising a closed inner wall surface; said male connecting member comprising an end-surface in juxtapositioned proximity to said closed inner wall surface of said cavity of said female connecting member., said end-surface defining a outside cylindrical surface and said closed wall surface defining a cooperating inside cylindrical surface, whereby said cylindrical surfaces act as over-solid abutment surfaces when excessive buffing forces exist, in order to protect said elastomeric bushing means from excessive compression.

7. The improvement according to claim 6, wherein said cylindrical surface comprises an upper and lower tapering surface defining therebetween a flat or curved central section spaced closer to the opposing juxtapositioned portion of said inside cylindrical surface than the spacing of any portion of said upper and lower tapering surfaces relative to an opposing juxtapositioned portion of said inside cylindrical surface, whereby vertical height misalignments of the respective said cylindrical surfaces are prevented from causing binding, locking and gouging of parts.

8. The improvement according to claim 6, wherein the spacing between the central sections of said concave and convex cylindrical surfaces is ¼ inch.

9. The improvement according to claim 1, wherein said female connecting member comprises an upper and a lower arm member delimiting therebetween said cavity of said female connecting member, said upper arm member having a hole formed therein for the passage of a portion of a king pin and defining an undersurface; said male connecting member further comprising a bushing plate means for retaining said bushing means in said hollow chamber, said plate means being mounted above said bushing means adjacent the upper end of said hollow chamber and defining an upper plate surface; said plate means also having an opening for the passage therethrough of a portion of a king pin; said upper plate surface being spaced from said undersurface of said upper arm member, whereby vertical angling between said female and male connecting parts is accommodated.

10. The improvement according to claim 9, in combination with a king pin; said opening of said plate means defining in inner annular stop surface, said king pin defining a telescoping portion passing through said opening of said plate means and spaced from said inner annular stop surface, whereby said inner annular stop surface and said telescoping portion of said king pin act as an over-solid limit stop against excessive draft forces, to thereby protect said elastomeric bushing means from such excessive draft forces.

11. The improvement according to claim 1, wherein the lower edge surface of said second inner metal ring is spaced from the upper surface of the lower wall portion defining said hollow chamber of said male connecting member.

12. In an articulated connector or coupler for railway cars, which connector or coupler comprises a female connecting member securable to an end of a first railway car, and a male connecting member securable to an end of another railway car, said female connecting member comprising a cavity for receiving therein a projecting portion of said male connecting member, said female connecting member having at least one opening for the passage therethrough of a king pin for rotatably uniting said male and female members together, the improvement comprising:

said male connecting member comprising an elastomeric bushing means, said projecting portion of said male connecting member comprising a hollow chamber in which is positioned said elastomeric bushing means; said bushing means comprising a central through-opening for the passage of a portion of a king pin therethrough:

said bushing means being circular in cross section and comprising a first outer metal ring, a second inner metal ring, and a third middle ring of elastomeric material, said central through-opening being formed in said second inner metal ring;

and a king pin, said king pin comprising an intermediate portion having a frustro-conical shape defining a tapering outer-surface; said central through-opening of said second inner ring of said bushing means having a frustro-conical shape for receiving therein said intermediate portion of said king pin, whereby assembly of said male and female connecting parts with said king pin is facilitated, and whereby inherent wear-compensation is provided by the interface between said bushing means and said intermediate portion of said pin.

13. The improvement according to claim 12, wherein said intermediate portion of said king pin is tapered at an angle of between 2 degrees and 7 degrees, said central through-opening of said inner ring also being tapered at an angle of between 2 degrees and 7 degrees.

14. The improvement according to claim 12, wherein said cavity of said female connecting member comprises a closed inner wall surface; said male connecting member comprising an end-surface in juxtapositioned proximity to said closed inner wall surface of said cavity of said female connecting member; said end-surface defining a outside cylindrical surface and said closed wall surface defining a cooperating inside cylindrical surface, whereby said cylindrical surfaces act as over-solid abutment surfaces when excessive buffing forces exist, in order to protect said elastomeric bushing means from excessive compression.

15. The improvement according to claim 14, wherein said outside cylindrical surface comprises an upper and lower tapering surface defining therebetween a flat or curved central section spaced closer to the opposing juxtapositioned portion of said inside cylindrical surface than the spacing of any portion of said upper and lower tapering surfaces relative to an opposing juxtapositioned portion of said inside cylindrical surface, whereby vertical height misalignments of the respective said cylindrical surfaces are prevented from causing binding, locking and gouging of parts.

16. The improvement according to claim 12, wherein said female connecting member comprises an upper and a lower arm member delimiting therebetween said cavity of said female connecting member, said upper arm member having a hole formed therein for the passage of a portion of a king pin and defining an undersurface; said male connecting member further comprising a bushing plate means for retaining said bushing means in said hollow chamber, said plate means being mounted above said bushing means adjacent the upper end of said hollow chamber and defining an upper plate surface; said plate means also having an opening for the passage therethrough of a portion of a king pin; said upper plate surface being spaced from said undersurface of said upper arm member, whereby vertical angling between said female and male connecting parts is accommodated.

17. In an articulated connector or coupler for railway cars, which connector or coupler comprises a female connecting member securable to an end of a first railway car, and a male connecting member securable to an end of another railway car, said female connecting member comprising a cavity for receiving therein a projecting portion of said male connecting member, said female connecting member having at least one opening for the passage therethrough of a king pin for rotatably uniting said male and female members together, the improvement comprising:

said male connecting member comprising an elastomeric bushing means, said projecting portion of said male connecting member comprising a hollow chamber in which is positioned said elastomeric bushing means; said bushing means comprising a central through-opening for the passage of a portion of a king pin therethrough said bushing means being circular in cross section and comprising a first outer metal ring, a second inner metal ring, and a third middle ring of elastomeric material, said central through-opening being formed in said second inner metal ring;

a king pin, said king pin passing through said at least one opening of said female connecting member and through said central through-opening of said bushing means; said male connecting member further comprising a lower opening positioned below and in alignment with said central through-opening of said bushing means through which passes a portion of said king pin; said king pin comprising at least a lower portion thereof that is substantially cylindrical in shape, said lower opening being greater in expanse than said lower portion of said cylinder and defining an inner annular surface surrounding the circumferential surface of said lower portion of said king pin to define a clearance therebetween at least along a portion thereof; said surfaces defining over-solid surface stops to limit the amount of compression experienced by said elastomeric bushing during excessive draft load forces.

18. In an articulated connector or coupler for railway cars, which connector or coupler comprises a female connecting member securable to an end of a first railway car, and a male connecting member securable to an end of another railway car, said female connecting member comprising a cavity for receiving therein a projecting portion of said male connecting member, said female connecting member having at least one opening for the passage therethrough of a king pin for rotatably uniting said male and female members together, the improvement comprising:

said male connecting member comprising an elastomeric bushing means, said projecting portion of said male connecting member comprising a hollow chamber in which is positioned said elastomeric bushing means; said bushing means comprising a central through-opening for the passage of a portion of a king pin therethrough;

said female connecting member comprising an upper and a lower arm member delimiting therebetween said cavity of said female connecting member, said upper arm member having a hole formed therein for the passage of a portion of a king pin and defining an undersurface; said male connecting member further comprising a bushing plate means for retaining said bushing means in said hollow chamber, said plate means being mounted above said bushing means adjacent the upper end of said hollow chamber and defining an upper plate surface; said plate means also having an opening for the passage therethrough of a portion of a king pin; said upper plate surface being spaced from said undersurface of said upper arm member, whereby vertical angling between said female and male connecting parts is accommodated;

a king pin, said opening of said plate means defining an inner annular stop surface, said king pin defining a telescoping portion passing through said opening of said plate means and spaced from said inner annular stop surface, whereby said inner annular stop surface and said telescoping portion of said king pin act as an over-solid limit stop against excessive draft forces, to thereby protect said elastomeric bushing means from such excessive draft forces.

19. The improvement according to claim 18, wherein said bushing means is circular in cross section and comprises a first outer metal ring, a second inner metal ring, and a third middle ring of elastomeric material, said central through-opening being formed in said second inner metal ring.

20. The improvement according to claim 18, wherein said cavity of said female connecting member comprises a closed inner wall surface; said male connecting member comprising an end-surface in juxtapositioned proximity to said closed inner wall surface of said cavity of said female connecting member; said end-surface defining a outside cylindrical surface and said closed wall surface defining a cooperating inside cylindrical surface, whereby said cylindrical surfaces act as over-solid abutment surfaces when excessive buffing forces exist, in order to protect said elastomeric bushing means from excessive compression.

* * * * *